United States Patent [19]

Erwin et al.

[11] 4,344,065

[45] Aug. 10, 1982

[54] CONVERGENCE INDICATOR FOR MARINE AND FLIGHT VEHICLES

[75] Inventors: Dennis C. Erwin, 6715 Riverside, Powell, Ohio 43065; Joseph A. Bowman; Joseph P. Marsalka, both of Columbus, Ohio

[73] Assignee: Dennis C. Erwin, Powell, Ohio

[21] Appl. No.: 170,939

[22] Filed: Jul. 21, 1980

[51] Int. Cl.[3] ..... G08G 3/02; G06G 7/78

[52] U.S. Cl. ..... 340/29; 340/286 M; 340/525; 340/711; 343/112 CA; 114/144 E; 364/461

[58] Field of Search ..... 340/29, 25, 26, 27 R, 340/27 AT, 27 NA, 515, 525, 286 M, 524, 711; 364/461, 460, 462, 715; 343/112 CA; 434/222, 223, 227, 228, 232, 29, 26; 114/144 R, 144 E; 358/104

[56] References Cited

U.S. PATENT DOCUMENTS

| | | | |
|---|---|---|---|
| 3,310,806 | 3/1969 | Stansbury | 343/112 CA |
| 3,849,782 | 11/1974 | Bond | 343/112 CA |
| 3,939,334 | 2/1976 | Roth et al. | 364/461 |
| 4,182,171 | 1/1980 | Looker | 340/27 NA |

*Primary Examiner*—John W. Caldwell, Sr.
*Assistant Examiner*—Donnie L. Crosland
*Attorney, Agent, or Firm*—Francis T. Kremblas, Jr.

[57] ABSTRACT

A visual aid for boat skippers to which a skipper inputs information about the relative position of another observed boat and a navigation light color which he observes. The device has a group of input switches each indicating a possible relative position of the second boat. Another group of switches indicates the possible navigation light colors of red, green and white. A display signals whether the input combination of position and lights is a potential collision condition. A collision detecting logic circuit connects the switches to a display for actuating the display in response to actuation of selected combinations of the switches.

1 Claim, 8 Drawing Figures

NONE
ASTERN
BOW
STARBOARD (BEAM)
STB.-STERN (QUARTER)
STB.-BOW
PORT (BEAM)
PORT-STERN (QUARTER)
PORT-BOW
NONE
WHITE
GREEN
GREEN AND WHITE
RED
RED AND WHITE
RED AND GREEN
RED, GREEN, WHITE
TO FIG. 4
TO FIG. 5
STN
BOW
STRBD
PORT
WHITE
GREEN
RED
CLEAR
COMP
ALL
Vcc R J Q CLK K GND
DIS THR TRIG GND
+5
5V
12V

FIG. 6

| DECODER OUTPUTS | | INPUT TO DECODER 114 | | | | INPUT TO DECODER 116 | | | X DENOTES DON'T CARE | |
|---|---|---|---|---|---|---|---|---|---|---|
| DECODER 114 I | DECODER 116 II | A PORT | B STBD | C BOW | D STERN | A RED | B GREEN | C WHITE | CONDITION | |
| 0 | 0 | 0 | 0 | 0 | 0 | 0 | 0 | 0 | ERROR | |
| | | 1 | 1 | X | X | X | X | X | ERROR | |
| | | X | X | 1 | 1 | X | X | X | ERROR | |
| 1 | 2 | 0 | 0 | 0 | 1 | 0 | 1 | 0 | COLLISION | |
| 1 | 3 | 0 | 0 | 0 | 1 | 0 | 1 | 1 | COLLISION | |
| 1 | 4 | 0 | 0 | 0 | 1 | 1 | 0 | 0 | COLLISION | |
| 1 | 5 | 0 | 0 | 0 | 1 | 1 | 0 | 1 | COLLISION | |
| X | 6 | X | X | X | X | 1 | 1 | 0 | COLLISION | |
| X | 7 | X | X | X | X | 1 | 1 | 1 | COLLISION | |
| 4 | 4 | 0 | 1 | 0 | 0 | 1 | 0 | 0 | COLLISION | |
| 4 | 5 | 0 | 1 | 0 | 0 | 1 | 0 | 1 | COLLISION | STB HALF BOAT ALSO LIGHTS |
| 5 | 4 | 0 | 1 | 0 | 1 | 1 | 0 | 0 | COLLISION | |
| 5 | 5 | 0 | 1 | 0 | 1 | 1 | 0 | 1 | COLLISION | STB HALF BOAT ALSO LIGHTS |
| 6 | 4 | 0 | 1 | 1 | 0 | 1 | 0 | 0 | COLLISION | |
| 6 | 5 | 0 | 1 | 1 | 0 | 1 | 0 | 1 | COLLISION | |
| 8 | 2 | 1 | 0 | 0 | 0 | 0 | 1 | 0 | COLLISION | |
| 8 | 3 | 1 | 0 | 0 | 0 | 0 | 1 | 1 | COLLISION | PORT HALF BOAT ALSO LIGHTS |
| 9 | 2 | 1 | 0 | 0 | 1 | 0 | 1 | 0 | COLLISION | |
| 9 | 3 | 1 | 0 | 0 | 1 | 0 | 1 | 1 | COLLISION | PORT HALF BOAT ALSO LIGHTS |
| 10 | 2 | 1 | 0 | 1 | 0 | 0 | 1 | 0 | COLLISION | |
| 10 | 3 | 1 | 0 | 1 | 0 | 0 | 1 | 1 | COLLISION | |

CONVERGENCE INDICATOR FOR MARINE AND FLIGHT VEHICLES

TECHNICAL FIELD

This invention relates to navigation and safety equipmnt for use aboard vehicles having running lights such as boats and airplanes and more particularly relates to a new type of computing device for signalling to an operator whether an observed vehicle is on a potential collision course with the operator's vehicle.

BACKGROUND ART

The primary purpose of the nautical rules of the road, which govern the operation of all boats, is to avoid collision. Good seamanship also dictates that the highest duty of a sailor is to avoid collisions in order to avoid loss of life, personal injury and property damage.

The rules of the road specify the use of navigation lights which are required on all boats. Running lights, which are those navigation lights which are shown while underway, are displayed at night so that a distant boat can observe not only the presence of the first boat but its approximate relative heading.

All boats are required to display at least one red and one green running light, the red being visible through an arc from ahead to 10 points off the port bow and the green being visible through an arc from ahead to 10 points off the starboard bow as illustrated in FIG. 1. Power boats must also display either a stern 12 point white light showing aft and a forward white light of 20 points showing forward or alternatively a 32 point white stern light visible around the horizon. In addition to the red and green lights, a boat under sail need only show the 12 point white stern light showing aft.

Knowledge of these lights permits a skipper of one vessel to determine the approximate relative heading of an observed vessel. Unfortunately it is difficult, especially for pleasure boat skippers who are not full time marine pilots, to quickly make a mental determination of relative heading from observation of the lights. It becomes especially difficult at night if the observed boat is approaching at a rapid rate of speed so that any necessary course changes must be made quickly and the skipper is therefore under pressure. Panic is a real possibility especially for a novice skipper. This problem is often further aggravated by the tired condition of a skipper attempting to reach a port after a long day on the water.

Although a great variety of navigation and safety equipment is well known for use on marine and air vehicles, none is known for use in determining or verifying whether an observed boat is on a potential collision course with an operator's boat.

There is therefore the need for a device which a skipper can use to quickly determine whether the observed boat is on a course which could potentially cause collision with his boat.

There is further a need for a device which will permit a skipper to verify his own judgment of the relative heading of the observed boat and which will alert him to the existence of a dangerous collision condition.

BRIEF DISCLOSURE OF THE INVENTION

The invention is a visual aid having pushbuttons which the skipper depresses to manually input information representing the relative position of the observed vehicle and the color of the navigation lights he observes. The apparatus determines whether the observed boat has a heading which is within a range of headings which potentially could result in a collision if both boats continue on the same course. If a potential collision condition exists the apparatus signals to the skipper. The apparatus of the invention includes a plurality of input switches, each associated with indicia indicating a relative position of a second vehicle with respect to a first vehicle. It also has a second plurality of input switches, each associated with indicia indicating a navigation light color. A visual display means is provided for signalling the existence of a potential collision condition. The input switches are connected to the display means through an intermediate collision-detecting, logic circuit means which actuates the display means in response to actuation of those combinations of the input switches which are the combinations having the potential or possibility of collision.

Accordingly it is an object of the present invention to provide an apparatus which can reduce the likelihood of collision by alerting a skipper to a potential collision.

It is another object of the present invention to provide a device for use as a verification system by experienced skippers.

Yet another object of the invention is to provide an apparatus which can be used for teaching and testing marine and flight students to aid them in learning to properly interpret observed navigation lights.

Yet another object of the present invention is to provide an apparatus which is easily operated by a skipper and will immediately provide him with an appropriate signal in a manner which does not significantly detract from his operation of the boat.

BRIEF DESCRIPTION OF THE DRAWINGS

FIG. 6 is a truth table describing the operating of a portion of the logic circuit of the present invention.

BEST MODE FOR CARRYING OUT THE INVENTION

Figure 2:
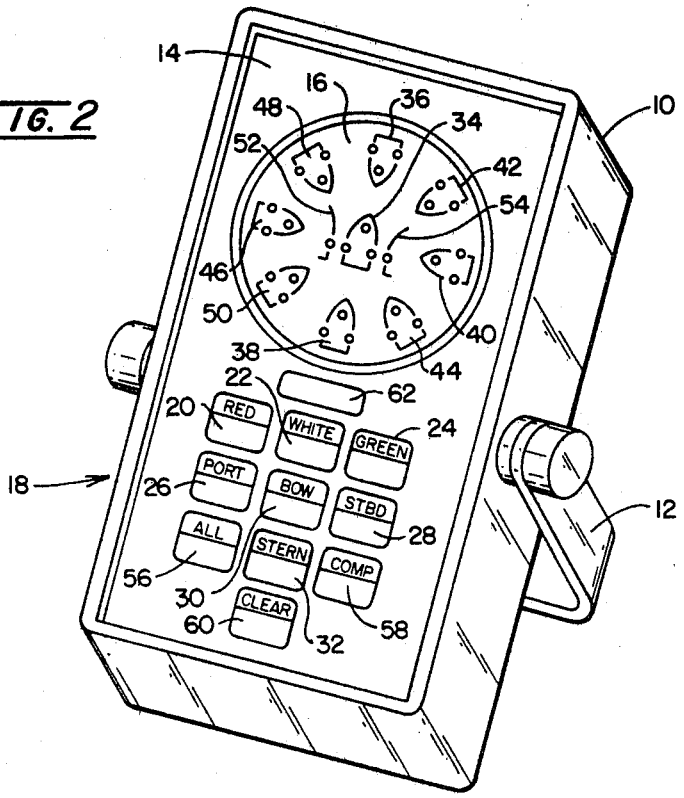
FIG. 2 is a view in perspective of a convergence indicator embodying the present invention.

FIG. 2 shows a convergence indicator which is the preferred embodiment of the invention. It has a cabinet 10 with a pivotable handle and support 12. This cabinet is mounted on the bridge or cockpit of the boat within easy access of the skipper. The face 14 of the convergence indicator includes a visual display 16 and a plurality of input switches of the conventional pushbutton type which make a circuit upon depression and break the circuit when released.

A first group of input switches 20, 22 and 24 is labelled with indicia indicating the navigation light colors, red, white and green, which a skipper can observe. A second group of input switches is associated with indicia which represent the relative position at which the second vehicle may be observed with respect to the first vehicle. Switches 26 and 28 are for port and starboard respectively, while switches 30 and 32 are for bow and stern respectively.

The skipper depresses those of the switches 20, 22 and 24 which correspond to the lights which he observes. The relative position of the observed boat is input to the convergence indicator by depression of one or two of the position indicating switches 26 through 32. Only switch 30 is depressed if a boat is observed ahead and only the switch 32 is depressed if the boat is observed astern. Similarly, only the switch 26 is depressed if a boat is observed off the port beam and only the switch 28 is depressed if a boat is observed off the starboard beam.

If the skipper observes a boat off the starboard bow he depresses the starboard switch 28 and the bow switch 30 and similarly if the boat is observed off the port bow he depresses the port switch 26 and the bow switch 30. If a boat is observed off the starboard quarter the skipper will depress the starboard switch 28 and stern switch 32 and if a boat is observed off the port quarter the skipper will depress the port switch 26 and the stern switch 32. Thus, if a skipper thinks in terms of starboard-stern and port-stern, in place of starboard-quarter and port-quarter in the same manner as he thinks in terms of starboard-bow and port-bow, an additional switch is not needed and the circuitry is simplified. However, the concept of the invention would include the addition of the extra switch.

The preferred display 16 comprises indicia in the form of schematic representation of a central boat 34, which represents the boat on which the convergence indicator is operated, and eight other boats spaced around the central boat. To dramatize their significance, these eight boats are preferably shown as being directed toward the central boat 34. However, the headings of these eight boats are not intended to be precise indications of the heading of the observed boat. They are intended to schematically represent a potential collision course and signal the existence of such a course rather than indicating accurately the course or heading of the observed boat.

The eight boats have relative positions with respect to the central boat 34 of ahead 36, astern 38, off the starboard beam 40, off the starboard bow 42, off the starboard quarter 44, off the port beam 46, off the port bow 48 and off the port quarter 50.

Figure 1A:
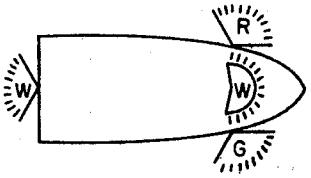
FIGS. 1(*a*), 1(*b*), and 1(*c*) are diagrams illustrating the navigation lights which are required on boats under 65 feet in length.
Figure 1B:
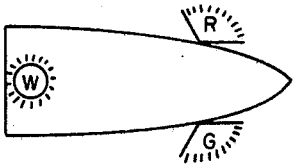
Figure 1C:
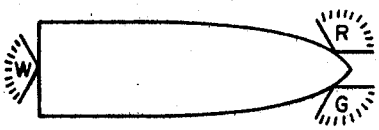

Each of these schematic representations of the boat is provided with a red, a white and a green running light in the appropriate positions as indicated in FIG. 1. Preferably the face of the display means 16 is formed of an opaque material which has translucent areas at the positions of the navigation lights and forming the boat outlines. Each of the eight boats may be backlighted by its own light which is selectively actuated by the circuit as described below to light its outline.

As will be described below in more detail, there is an ambiguity in certain observed light conditions in that for light combinations a boat off the beam or off the quarter may be either on a converging course toward the operator's boat 34 or running parallel to it. In order to display this ambiguity there are schematic representations of half boats 52 and 54 running parallel to the operator's boat 34 on the starboard and port sides respectively.

In addition to the navigation color light input switches 20–24 and the relative position input switches 26–32 described above, the preferred embodiment of the invention is also provided with a switch 56 labelled "All," a switch 58 labelled "Compute" and a switch 60 labelled "Clear."

The depression of the switch labelled "All" causes all of the indicia which are schematic representations of a boat on the display 16 to be illuminated in order to check the condition of the display and to familiarize the operator with it. The face of the convergence indicator is also provided with an "error" signal light 62 which will be illuminated in the event that an operator depresses a combination of switches which is not physically possible, for example, if the operator would push the "bow" and "stern" switches 30 and 32 or the "starboard" and "port" switches 26 and 28.

The convergence indicator illustrated in FIG. 2 is operated by depressing those switches which indicate the colors of the navigation lights which are observed and those switches indicating the relative position at which they are observed. After inputting this information by depressing the appropriate switches, the operator depresses the compute switch 58. If the selected input conditions do not represent a potential collision situation, the convergence indicator will not respond. However, if the input conditions are such that a collision is possible, then the particular schematic representation of the boat which is at the relative position of the observed boat will flash with its navigation lights corresponding to the navigation lights observed by the skipper of the operator's boat 34 and its backlight will be turned on to illuminate its outline. This state will continue until the operator depresses the clear switch 60 to clear the convergence indicator for another entry. The convergence indicator has various other operating capabilities and features which will be described in more detail with respect to the electronic schematic diagrams of FIGS. 3 through 5.

Within the cabinet 10 the switches illustrated in FIG. 2 are connected to the inputs of a collision-detecting, logic circuit means contained within the cabinet 10, the outputs of which are connected to the display means 16 for actuating the display means 16 in response to actuation of selected combinations of the switches. This collision-detecting logic circuit means together with additional circuitry is illustrated in FIGS. 3–5.

Figure 3:
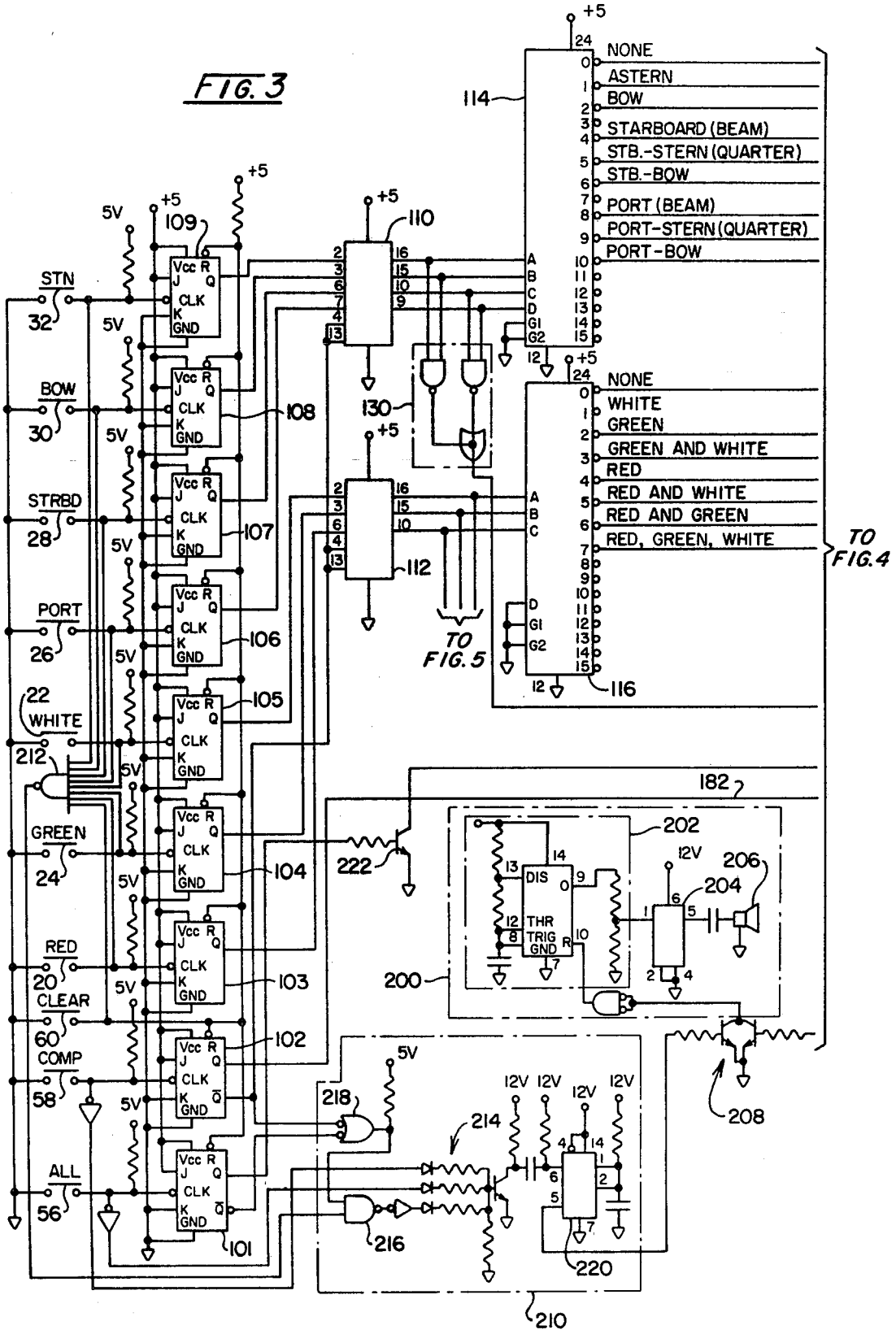
FIGS. 3 through 5 are schematic diagrams of the electronic circuitry of the preferred embodiment of the invention.
Figure 4:
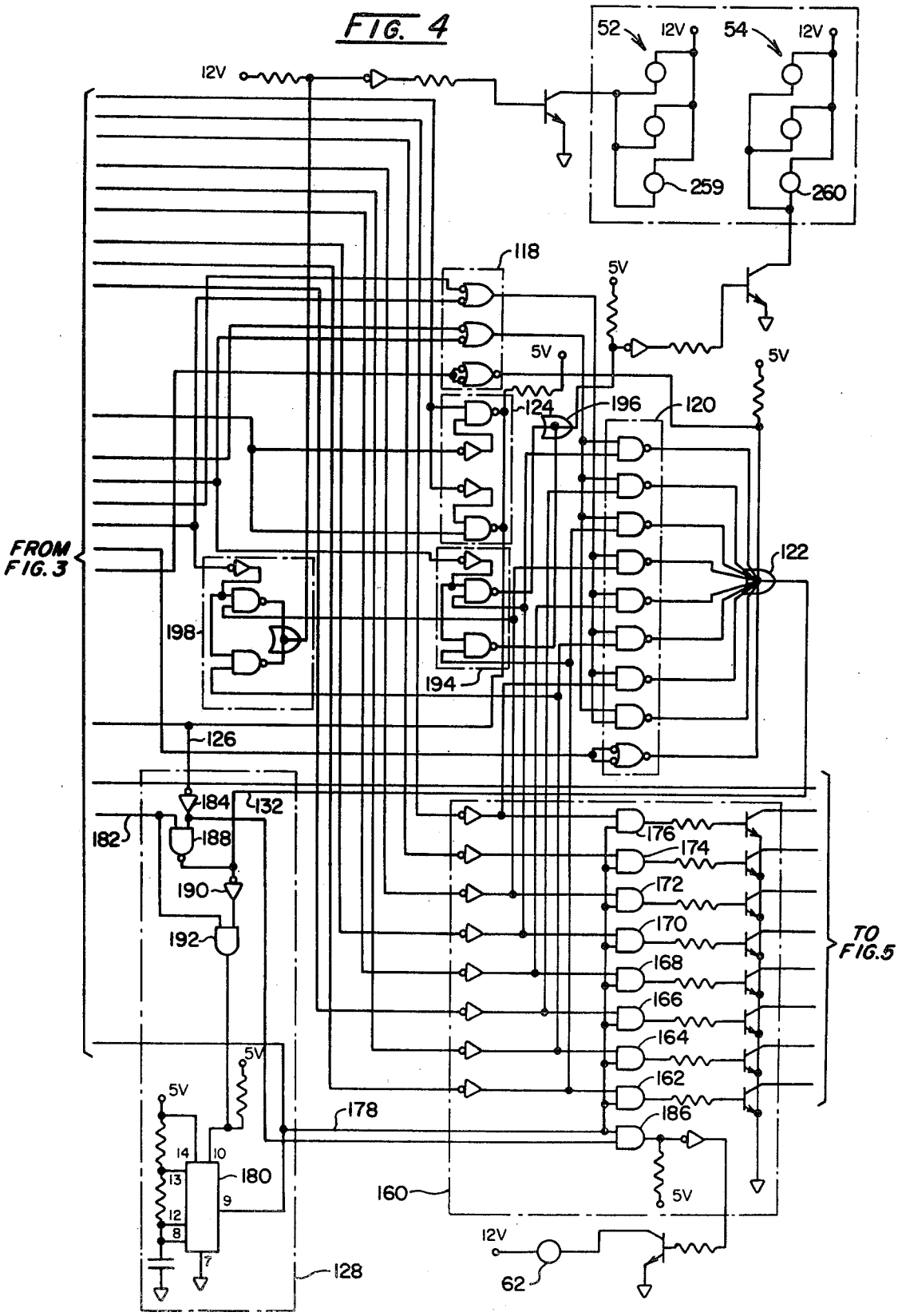
Figure 5:
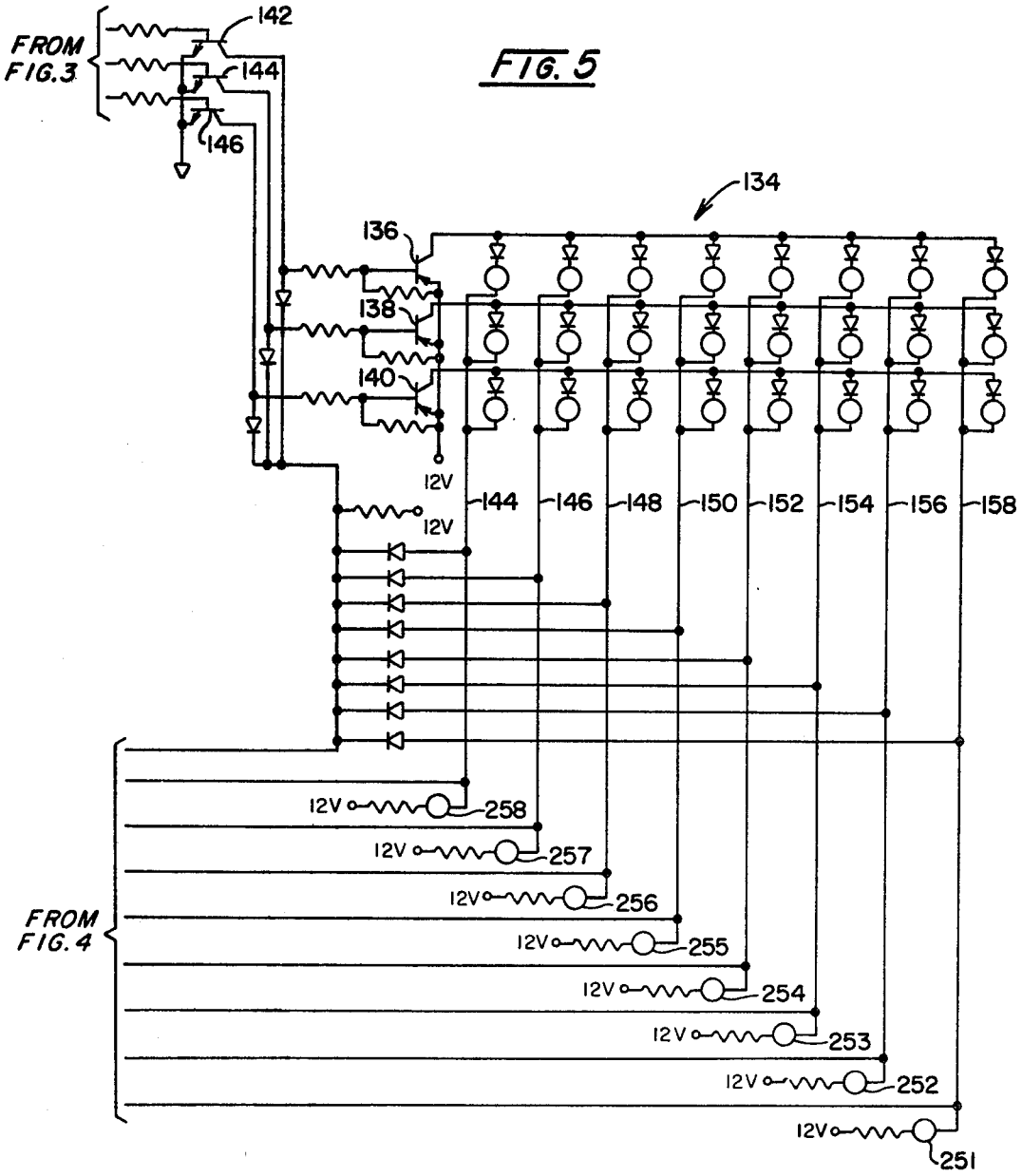

Referring now to FIGS. 3–5 and beginning with FIG. 3, each of the switches 20–32 and 56 and 58 is connected to the clock input terminal of one of nine JK flip-flops 101–109, each flip-flop being associated with one of those switches. The purpose of each is to change state in response to momentary depression of its associated switch in order to store the momentary switch actuation. For this purpose their J inputs are connected to the 12 volt power supply voltage and their K inputs are connected to ground. Therefore, depression of a switch will provide a clock pulse to an associated flip-flop which will switch its Q output from a low to a high state and its $\overline{Q}$ output from a high to a low state.

The Q outputs from the flip-flops 103 through 109, which represent the input of navigation light colors and the relative position of an observed boat, are each connected to an input of its own bistable latch. These bistable latches are formed in the bistable latch integrated circuits 110 and 112.

The clock inputs for the bistable latches on the devices 110 and 112 are connected to the $\overline{Q}$ output of the flip-flop 102 so that when the compute switch 58 is depressed and flip-flop 102 consequently switches states, the navigation light color data and relative position data in flip-flops 103 through 109 will be strobed into the bistable latch devices 110 and 112. Thereafter the accidental switching of any switches cannot cause variation of the data stored in the bistable latches 110 and 112.

The four outputs of the bistable latch 110 are connected to the inputs of a four line to sixteen line decoder 114. Similarly, the three outputs from the bistable latching device 112 are connected to the inputs of another four line to sixteen line decoder 116.

Each output of the decoder 114 represents a unique one of the sixteen possible combinations of relative position switch inputs. Those relative position input combinations which are invalid, which are those containing both port and starboard or bow and stern, are unused and therefore each one of the eight used terminals at the output of the decoder 114 represent one of the eight possible relative positions of the observed boat. The output terminal of the decoder 114 which represents a selected relative position goes from a logic high to a logic low when selected.

In a similar manner the outputs of the decoder 116 each represent a unique combination of navigation light colors. Only the valid combinations are used. For example, two or more of any one color are not possible with this system.

The outputs of decoders 114 and 116 are connected to logic gates 118 and 120 for detecting the existence of a potential collision condition. The outputs of the logic gates 118 and 120 are ultimately applied to the EXCLUSIVE OR gate 122, the output of which switches to a logic low state upon the occurrence of a collision condition.

Pin 0 of the decoder 114 and Pin 0 of the decoder 116 are connected to error detection logic gates 124 in order to detect an error condition. The error condition which is detected is the actuation of no navigation light switch and no relative position switch. The output of the error detection logic gates 124 is connected to an error input terminal 126 of a display control circuit 128. It actuates the flashing of the error signal 62 if the compute switch 58 is actuated and no relative position or navigation color light switch has been actuated.

Another error detection circuit 130 has its inputs connected to the outputs of the bistable latch 110. This circuit 130 detects the existence of the invalid conditions bow and stern or starboard and port. The output of the error detection circuit 130 is also connected to the error input terminal 126 of the display control circuit 128. Thus, if either of these two invalid conditions is selected and the compute button is depressed, the error signal will be flashed.

The truth table of FIG. 6 describes the operation of the error logic circuits 124 and 130 and the collision-detection logic circuit 120 and its associated EXCLUSIVE OR gate 122. The table shows the conditions under which the logic circuitry will cause the error signal to be actuated and the conditions under which a collision condition will be detected by the switching of the output of the EXCLUSIVE OR gate 122, the output of which is connected to input 132 of the display control circuit 128.

Referring to FIG. 5, the running lights on the schematic representation of the eight boats which are spaced around the central boat on the display 16 are connected in a 3×8 matrix 134. The three navigation light color inputs 136, 138 and 140 to the matrix 134 are connected through drive transistors 142, 144 and 146 to the three outputs of the bistable latch 112. These drive transistors enable those color rows which correspond to the navigation light switches which have been depressed by the operator. For example, if green and white have been actuated by depression of switches 22 and 24, then the green and white rows in the matrix 134 are enabled.

The eight column inputs 144 through 158 to the matrix 134 each represent one of the selectable relative positions for the observed boat and correspond to one of the eight boats surrounding the central boat 34 on the display 16. These eight inputs 144 to 158 are connected through a matrix drive circuit 160 to the outputs of the decoder 114.

The matrix drive circuit 160 includes AND gates 162 through 176, one for each of these relative boat positions. Thus, actuation of a single one of the matrix columns at inputs 144 through 158 will be enabled by the corresponding output from the decoder 114. Actuation of the running lights of the matrix 134 at the selected row and column intersections will then occur upon an appropriate input to the AND gates 162 through 176 from the output 178 of the display control circuit 128.

The display control circuit 128 includes an integrated circuit 180 which is connected as an astable flip-flop oscillator for causing a flashing of the lights, of the error signal and of a beeping tone in response to appropriate input conditions to its inputs 132, 126 and 182.

For example, the input 126, which is switched to a logic low state in response to the existence of an error condition, is applied through an inverter 184 to the NAND gate 186 in order to actuate the error light 62 in accordance with the flashing output at the output terminal 178. However, because of connection through the NAND gate 188, the inverter 190 and the AND gate 192, the astable flashing oscillator 180 will not be actuated until the compute switch 58 is depressed to cause a logic high at the input 182 of the display control circuit 128.

Similarly, if a collision condition exists which causes the input 132 to the display control circuit 128 to be switched to a logic low condition and the compute switch 58 is actuated, which switches the input 182 to a logic high, the flasher circuit 180 will be actuated to flash those running lights of the matrix 134 which have been selected and enabled as described above.

If the compute switch 58 is depressed and there is neither an error condition nor a collision condition, the flashing circuit 180 is not actuated and therefore the display will not be actuated. This occurs when an observed boat is not on a potential collision course.

The observation of green and white navigation lights off the port quarter has two possible interpretations. One is that a potential collision course exists in which event the schematic representation of a boat 50 off the port-quarter on the display 16 will be actuated with the identical navigation lights illuminated. Alternatively, however, the green and white lights off the port quarter could indicate that the observed boat is on a course parallel to the operator's boat.

In order to signal this condition, a port half boat logic circuit 194 is provided having inputs connected to pin 9 of the decoder 114 and pin 3 of the decoder 116. The outputs of the port half logic circuit 194 are connected to an exclusive OR gate 196, the output of which is connected to the port half boat lights 52 for actuating the lights of the port side parallel schematic boat representation 52 of the display 16.

The same is true for a boat observed off the port beam. Therefore, with this circuitry the port side parallel boat 52 is actuated in response to the observation of green and white navigation lights off the port quarter or off the port beam.

Similarly, a starboard half boat selection circuit 198 is connected to detect the observation of red and white navigation lights off the starboard quarter or off the starboard beam. Its output is connected to the starboard parallel half boat lights 54 so that they will be illuminated in response to the observation of red and white lights off the starboard quarter or off the starboard beam.

An audio signalling circuit 200 is provided for giving audio signals to the operator of the convergence indicator. The circuit 20 includes an audio oscillator 202 connected through an audio amplifier 204 to a speaker 206. The audio signal is sounded under control of the OR gate 208 formed of discrete components.

One input to the OR gate 208 which will cause operation of the audio output signal is from the output pin 9 of the flashing oscillator 180. Therefore, the audio output tone is transmitted by the speaker 206 simultaneously and in direct correspondence with the flashing of the error signal 62 or the flashing of the navigation lights of the matrix 134 in the event of a detected collision condition.

A switch verification circuit 210 is also provided in order to give a brief audio beep output in response to the depression of any of the switches 20 through 32 or 56 through 60.

To accomplish this each of the switches 20 through 32 and the switch 60 are connected to the input of a NAND gate 212. The switches 58 and 56 are connected to a discrete-component OR gate 214. The output of the NAND gate 212 is connected to the input of NAND gate 216. Additionally, the $\overline{Q}$ outputs of flip-flops 101 and 102 are connected to an OR gate 218 which in turn is connected at the other input of the NAND gate to 216.

The outputs of the gates 214 and 216 are connected to an integrated circuit 220 which operates as a "one shot" for turning on the tone through the discrete OR gate 208 for a brief interval of time.

Therefore, whenever any one of the input switches is depressed, the one shot 220 will be actuated unless the compute switch 58 or the All switch 56 had previously been actuated. The OR gate 218 upon actuation of the "All" switch 56 or the "Compute" switch 58, switches its output state so that subsequent depression of switches will not cause a change in the output of the AND gate 216 and therefore will not generate a brief beep.

The backlighting lights 251–258 for illuminating the outlines of the eight surrounding boats 36–50 are connected to their corresponding relative position outputs from the matrix drive circuit 160. A selected one is illuminated for the selected relative boat position if a collision condition exists. Similarly, the back lights 259 and 260 for the half boats are connected to be illuminated when the navigation lights of a particular half boat are illuminated.

The operation of the circuit of FIGS. 3 through 5 might begin with the operator depressing the "All" switch 56. This will result in switching the states of the flip-flop 101 and also the actuation of the one shot 220 to give a brief beep tone. Further beep tones would be prevented by switching of the output state of the OR gate 218.

Switching of the flip-flop 101 will turn on all navigation lights by switching a drive transistor 222 which is connected through the diodes 224 to the inputs 144 through 158 of the matrix 134. This path bypasses the matrix drive circuit 160 so that all lights will be illuminated to test their operation.

The operator would then depress the clear switch 60 which is connected to the reset inputs of all the flip-flops 101 through 109. The circuit is then ready for the receipt of input information.

The operator, upon observing another boat, depresses the appropriate switches to indicate the colors which correspond to the colors which he observes and the relative position at which they are observed. After inputting this information, the operator depresses the compute switch 58 which causes a change of state of the flip-flop 102. The state change of the flip-flop 102 through the connection to its $\overline{Q}$ output, latches the data from the flip-flops 103–109 into the bistable latches 110 and 112. The state change from the Q output of the flip-flop 102 enables the NAND gate 188 and the AND gate 192 so that the flashing oscillator 180 will be operated upon detection of an error condition at the input 126 of the display control circuit 128 or a collision condition at the input 132 of the display control circuit 128.

The data latched into the bistable latches 110 and 122 is converted by the decoders 114 and 116 and applied to the logic circuitry as described above for enabling the appropriate rows and columns of lights of the matrix 134 and for detecting whether a collision condition or error condition exists. If an error or collision condition is detected, then the matrix drive circuit 160 flashes the selected lights or the error lights to make the appropriate signal. If no collision condition or error is detected, none of the lights of the display are actuated.

In either case the operator may then depress the clear button to make another entry whenever he desires.

The logic circuitry described above is only one form which the logic circuitry may take as is well known to those skilled in the art. Additionally, a microcomputer circuit may be used to perform the same logic functions and may expand the concept further, for example, by including more switches. The switches might be used, for example, to include stacked lights for indicating conditions such as boats in tow, barges, anchored boats and tugs with tow astern, along side or ahead.

While most of the above terminology is descriptive of marine vehicles, by analogy the description and the device is usable in an analogous manner in air vehicles.

It is to be understood that while the detailed drawings and specific examples given describe preferred embodiments of the invention, they are for the purposes of illustration only, that the apparatus of the invention is not limited to the precise details and conditions disclosed and that various changes may be made therein without departing from the spirit of the invention which is defined by the following claims.

We claim:

1. An improved apparatus for signalling to an operator of a first vehicle the existence of a potential collision condition with respect to a second vehicle having navigation lights, said apparatus having: a plurality of input switches each associated with indicia indicating a relative position of said second vehicle with respect to said first vehicle said position indicia comprising ahead, astern, starboard and port or equivalent indicia; a plurality of input switches each associated with indicia indicating a navigation light color; visual display means for signalling a potential collision condition, said display means comprising indicia in the form of schematic representations of eight boats having, with respect to a central boat, different relative positions of ahead, astern, off the starboard bow, off the starboard beam, off the starboard quarter, off the port bow, off the port beam and off the port quarter, each of said eight boat indicia having a red, a white and a green running light thereon; collision detecting logic circuit means connected to said switches and said running lights on said eight boats for energizing each selected light of the selected boat position in response to a potential collision condition; wherein the improvement comprises:

(a) parallel boat forming indicia as a part of said display means in the form of schematic representations of at least a portion of a boat on each side of and parallel to said central boat, the parallel boat on the port side of said central boat having green and white running lights and the parallel boat on the starboard side having red and white running lights; and (b) a parallel boat logic circuit means having inputs connected to said collision detecting logic circuit means and outputs connected to the running lights of said parallel boats for actuating the lights of the parallel boat on the starboard side of said central boat in response to actuation of the starboard, stern, red, white and no other switches and in response to actuation of the starboard, red, white and no other switches and for actuating the lights of the parallel boat on the port side of said central boat in response to actuation of the port, green, white and no other switches and in response to actuation of the port, stern, green, white and no other switches.

* * * * *